US006081933A

United States Patent [19]

Partsch, IV

[11] Patent Number: 6,081,933

[45] Date of Patent: Jul. 4, 2000

[54] HELMET BILL SAFETY COVER

[75] Inventor: George J. Partsch, IV, 3710 Tovar Way, Chino Hills, Calif. 91709

[73] Assignee: George J. Partsch, IV, Chino Hills

[21] Appl. No.: 09/023,268

[22] Filed: Feb. 13, 1998

[51] Int. Cl.[7] ..... A42B 3/00

[52] U.S. Cl. ..... 2/422; 2/195.1

[58] Field of Search ..... 2/410, 411, 422, 2/425, 12, 195.1, 195.5, 195.6, 200.2, 175.2, 209.13

[56] References Cited

U.S. PATENT DOCUMENTS

| | | | |
|---|---|---|---|
| D. 246,681 | 12/1977 | Hursh | D2/260 |
| 3,072,915 | 1/1963 | Henschel | 2/195.6 |
| 3,146,462 | 9/1964 | Militello | 2/410 |
| 3,263,235 | 8/1966 | Young | 2/422 |
| 3,435,460 | 4/1969 | Grant | 2/422 |
| 4,312,076 | 1/1982 | Gamm | 2/199 |
| 5,003,639 | 4/1991 | White | 2/209.13 |
| 5,070,545 | 12/1991 | Tapia | 2/195 |
| 5,287,559 | 2/1994 | Christiansen et al. | 2/181 |
| 5,437,062 | 8/1995 | Douglas | 2/195.1 |
| 5,575,017 | 11/1996 | Hefling et al. | 2/425 |
| 5,659,896 | 8/1997 | Taylor | 2/209.13 |
| 5,701,607 | 12/1997 | Kaiser | 2/209.13 |

FOREIGN PATENT DOCUMENTS

| | | | |
|---|---|---|---|
| 736700 | 11/1932 | France | 2/195.1 |
| 544868 | 4/1942 | United Kingdom | 2/411 |

*Primary Examiner*—Michael A. Neas

[57] ABSTRACT

A helmet bill safety cover is comprised of a generally crescent-shaped, resilient sleeve with a convex front edge, and a concave rear edge. A slot extends partially into the sleeve from the rear edge. The ends of an elastic strap are attached to opposite sides of the sleeve. The sleeve is slipped over the rigid bill of a helmet, and the strap is wrapped around the back of the helmet. The sleeve is thick and soft enough to cushion the impact and reduce or prevent injury when the bill strikes another person.

1 Claim, 1 Drawing Sheet

HELMET BILL SAFETY COVER

BACKGROUND OF THE INVENTION

1. Field of the Invention

This invention relates generally to helmets.

2. Prior Art

A baseball batter wears a batting helmet, which is typically a rigid plastic helmet with a rigid visor or bill. After hitting a ball, the batter becomes a runner who runs to a base as quickly as possible. At the same time, an outfielder picks up the ball, and throws it to a fielder at the base the runner is rushing to. If the fielder catches the ball just before the runner arrives at the base, the fielder will rush toward the runner to touch him with the ball before he contacts the base. Therefore, the fielder and runner almost always approach each other at great speed. Forceful contact between the two frequently occurs, and the thin hard edge of the helmet's bill may cause injury if it strikes the fielder. When this inventor was in Little League baseball, he was hit in his Adam's apple by the bill of a helmet worn by a runner who slid into base. The injury was very painful. Later he heard of a fielder who was killed when hit in the throat by a helmet bill. Therefore, there is a need to protect players from such danger.

U.S. Pat. No. 4,312,076 to Gamm shows a soft cap with an integral pocket. U.S. Pat. No. 5,070,545 to Tapia shows a baseball cap with interchangeable fabric bills. U.S. Pat. No. 5,287,559 to Christiansen et al. shows a cover for the strap of a baseball cap. U.S. Pat. No. 5,437,062 to Douglas shows a baseball cap with a detachable fabric bill. U.S. Pat. No. Des. 246,681 to Hursh shows a hat bill and brim. U.S. Pat. No. Des. 294,877 to Burley shows a bill or visor for a baseball cap. Although some of the prior art show soft bills, none is suitable for use on a batting helmet.

OBJECTS OF THE INVENTION

Accordingly, the object of the present invention is to reduce or prevent injury when the rigid bill of a helmet strikes another person. Further objects of the present invention will become apparent from a consideration of the drawings and ensuing description.

BRIEF SUMMARY OF THE INVENTION

A helmet bill safety cover is comprised of a generally crescent-shaped, resilient sleeve with a convex front edge and a concave rear edge. A slot extends partially into the sleeve from the rear edge. The ends of an elastic strap are attached to opposite sides of the sleeve. The sleeve is slipped over the rigid bill of a helmet, and the strap is wrapped around the back of the helmet. The sleeve is thick and soft enough to cushion the impact and reduce or prevent injury when the rigid bill strikes another person.

DRAWING REFERENCE NUMERALS

10. Sleeve
11. Front Edge

12. RearEdge
13. Side
14. Side
15. Slot
16. Strap
17. Helmet
18. Bill

DETAILED DESCRIPTION OF THE INVENTION

Figure 1:
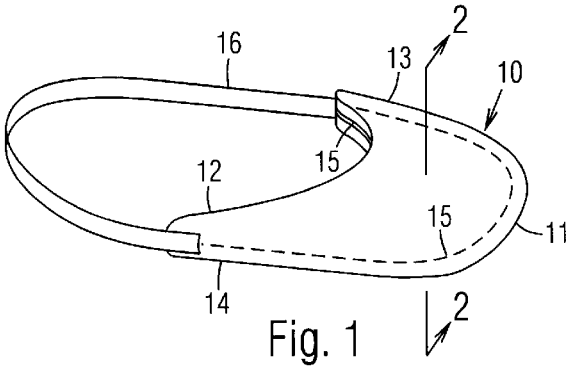
FIG. 1 is a side perspective view of the present helmet bill safety cover.
Figure 2:
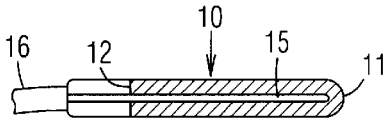
FIG. 2 is a side sectional view of the safety cover.

A preferred embodiment of the helmet bill safety cover is shown in the side perspective view in FIG. 1 and the sectional view in FIG. 2. It comprises a thick, generally crescent-shaped sleeve 10 with a convex front edge 11, a concave rear edge 12, and opposite sides 13 and 14. Sleeve 10 is made of a resilient material, such as spongy foam, with suitable impact absorbing properties. A slot 15 extends partially into sleeve 10 from rear edge 12. The inner edge of slot 15 is substantially spaced from forward edge 11. The ends of an elastic strap 16 are attached to opposite sides 13 and 14.

Figure 3:
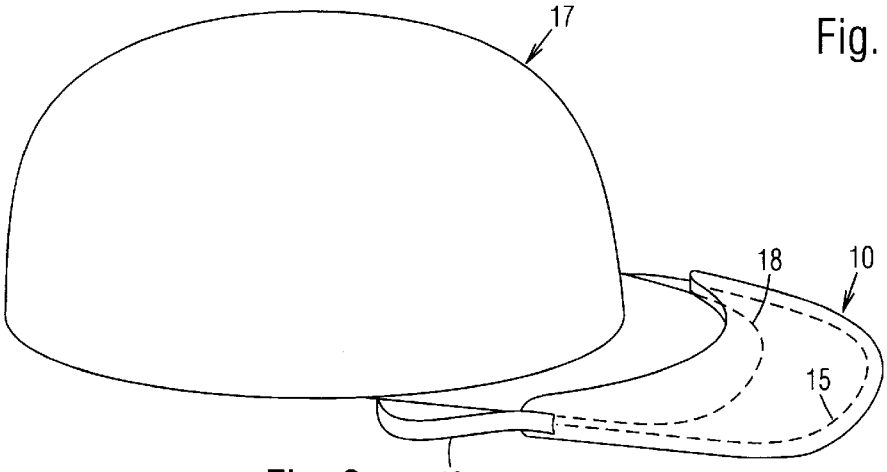
FIG. 3 is a side perspective view of the safety cover being attached to a helmet.
Figure 4:
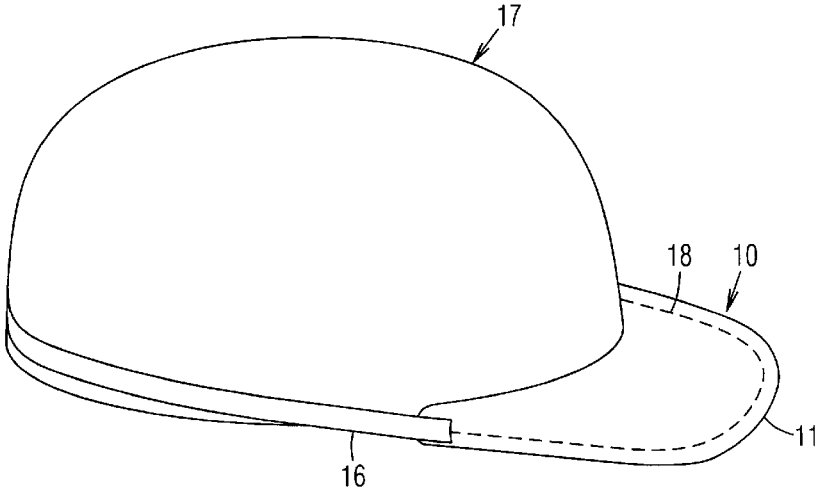
FIG. 4 is a side perspective view of the safety cover attached to the helmet.

The safety cover is shown being attached to a helmet 17 in FIG. 3. A rigid bill 18 of helmet 17 is slipped into slot 15, which is preferably sized for a snug friction fit. When sleeve 10 is fully seated over bill 18, as shown in FIG. 4, strap 16 is wrapped around the back of helmet 17 to secure sleeve 10 in position. There is a substantial thickness of resilient material between the edge of bill 18 and front edge 11 of sleeve 10, so that when another person is struck by rigid bill 18, the impact is absorbed by sleeve 10, and injury is reduced or prevented.

SUMMARY AND SCOPE

Accordingly, a helmet bill safety cover has been provided. It absorbs the impact and reduces or prevents injury when the rigid bill of a helmet strikes another person.

Although the above description is specific, it should not be considered as a limitation on the scope of the invention, but only as an example of the preferred embodiment. Many substitutes and variations are possible within the teachings of the invention. For example, sleeve 10 can be made of any suitable resilient material with suitable impact absorbing properties. Sleeve 10 can be reduced to a narrow strip for covering only the front edge of bill 18. Strap 16 may be non-elastic, and can include a buckle. Logos and graphics may be printed on sleeve 10. The safety cover can be made in different sizes for fitting different helmets, and can be used on any type of helmet with a rigid bill. Therefore, the scope of the invention should be determined by the appended claims and their legal equivalents, not by the examples given.

I claim:

1. A helmet bill safety cover, comprising:

a sleeve made of a shock absorbing resilient material, said sleeve having a front edge, a rear edge, and opposite sides, said sleeve having a slot extending inwardly from said rear edge for slipping over a rigid bill of a helmet, an inner end of said slot being spaced from said front edge of said sleeve; and a strap with opposite ends attached to said opposite sides of said sleeve for strapping around a back of said helmet, said sleeve for absorbing impact when said rigid bill strikes a person and thus reducing injury thereto.

* * * * *